United States Patent [19]

Okkerse et al.

[11] Patent Number: 4,463,345

[45] Date of Patent: Jul. 31, 1984

[54] SEED FLOW MONITOR

[75] Inventors: Simon W. J. H. Okkerse; Robert J. Friesen; James D. J. Robar, all of Saskatoon, Canada

[73] Assignee: SED Systems Inc., Saskatoon, Canada

[21] Appl. No.: 313,531

[22] Filed: Oct. 22, 1981

[30] Foreign Application Priority Data

Oct. 23, 1980 [CA] Canada ..... 363074

[51] Int. Cl.[3] ..... G08B 26/00

[52] U.S. Cl. ..... 340/505; 340/524; 340/534; 340/684; 340/825.05; 340/825.54; 340/825.64

[58] Field of Search ..... 340/684, 524, 534, 505, 340/825.05, 825.49, 825.54, 825.62

[56] References Cited

U.S. PATENT DOCUMENTS 2,842,753 7/1958 Ewen ..... 340/505

3,508,260 4/1970 Stein ..... 340/505 X 4,238,790 12/1980 Balogh et al. ..... 340/684

4,369,895 1/1983 McCarty et al. ..... 340/684 X

*Primary Examiner*—David L. Trafton

*Attorney, Agent, or Firm*—Alan H. Levine

[57] ABSTRACT

A seed flow monitor for use with a plurality of seed flow sensors which are located in individual tubes of a field seeder. In the event of detection of reduction of seed flow in any seed tube below a predetermined threshold, a pulse signal is sent to a central display via circuits, associated with each group of seed flow sensors, connected in series. Each of the circuits modifies the pulse signal in a predetermined similar manner, resulting in a pulse signal received at the central display which is unique to the group of seed tubes originating the pulse signal. Preferably the pulse signal is constantly transmitted to the circuits by the central display, and is merely coupled into the series of circuits upon detection of the seed flow below the threshold. The cabling complexity from the sensors to the control display is thus substantially reduced and reliability is enhanced.

16 Claims, 7 Drawing Figures

SEQUENCER
SEED DETECTORS
COUNTER
DEMUX & LATCH
LED
LED
SINGLE PULSE REMOVER
COUNTER
DEMUX
MV
PIEZOELECTRIC ELEMENTS

SEED FLOW MONITOR

This invention relates to seed flow monitoring apparatus, and more particularly to a system for detecting and indicating the absence of seed flow associated with one of a plurality of seed flow detectors.

A seeder may typically have 48 seed tubes down which seeds pass prior to ejection to the farmer's field. From time to time the seed tubes may suffer blockage, and without an indicator it is virtually impossible for the operator of the seeder alone to detect the cessation of seed flow in the blocked tube until a substantial distance has been missed, resulting in poor efficiency of utilization of the field, i.e., a reduction in yield.

Various seed monitoring apparatus has been proposed. For instance, in U.S. Pat. No. 3,927,400 issued Dec. 16, 1975 to Dicky-John Corporation entitled EFFICIENCY MONITORING SYSTEM FOR SEED PLANTING APPARATUS, a system is described which indicates whether the quantity of seeds planted is greater or fewer than a given quantity. In this system monitors associated with individual seed tubes are scanned for periods of, for example, 10 seconds each, and the system provides an alarm if the seed flow has stopped. However it will be recognized that with 48 seed tubes, blockage in a seed tube just after that seed tube has been scanned would allow over 700 feet of one row to be unplanted (at a seeding rate of 5 miles per hour) before detection of the malfunction.

Further, outputs from each detector must be individually connected to the control circuit, resulting in a heavy and complex cable, subject to failure, interconnecting the apparatus with the control unit.

In U.S. Pat. No. 3,723,980, issued Mar. 27, 1973 to Dicky-John Corporation, entitled ELECTRONIC PLANTER MONITOR, another system is described which monitors each individual seed tube, and provides to an operator an alarm light corresponding to a particular seed tube, indicating a flow rate less than a particular rate. This system, as the one described above, utilizes individual transmission wires from each sensor to the control unit, again resulting in a bulky cable holding as many as 48 wires or wire pairs (where there are 48 seed tubes) leading to the control unit.

The present invention is a seed tube monitor which almost immediately indicates to the seeder operator that the seed flow rate is below a predetermined minimum or has stopped in a group of associated seed tubes. The operator can stop the seeder and apply a test instrument to a test plug associated with the group, or can inspect the seed tubes in the group visually, to determine exactly which seed tube has become blocked. This facility is provided utilizing only two signal carrying wires and ground (and a pair of power supply wires). Sequencers associated with each group of seed tubes are connected in series, and in the event it is desired to remove a group of seed tubes or the detectors associated therewith, the local sequencers may merely be disconnected and the cables connected thereto can be merely connected together. Yet even with this flexibility the remaining circuitry operates as before, but without the local set of seed tube detectors. Thus the sensors and associated local circuitry, the latter referred to below as sequencers, can be removed or others added in any arbitrary manner.

The indicator provides to the operator either a light or numerical display to indicate which group of seed sensors, numbered sequentially down the cable from the operator, has malfunctioned, almost immediately following the malfunction.

Thus in contrast to the prior art systems which monitor seed flow in a plurality of seed tubes, each sending a signal to a control unit, with the control unit detecting which monitor has malfunctioned by detecting which individual cable the malfunction signal has been received from, the present invention transmits a predetermined digital signal along a signal cable from one or a group of seed tube detectors at which a malfunction has been detected, the signal received at the control unit detecting a malfunction signal which is unique for each one or group of seed tube detectors.

In order to simplify the circuitry and make the system as error free as possible, a sequencer associated with each one or group of seed tube detectors transmits an identical signal along the cable to the control and display unit. However the signals are modified as they pass down the cable to the control and display unit, resulting in a received alarm signal which is unique to each sequencer. Each unique signal is decoded and displayed at an unique indicator position.

In general, the invention is a seed flow monitor comprising detectors for detecting the flow of seeds in a plurality of seed tubes, and a sequencer circuit associated with each one or a group of the detectors for transmitting an alarm signal along a transmission line upon detection of the flow of seeds being below a predetermined flow rate in a seed tube. A circuit is utilized for detecting and decoding an unique form of the alarm signal associated with each one or group of the detectors, and a display circuit enables indicators each corresponding to the forms of the alarm signal detected.

Preferably the alarm signal transmitted by each transmitting means is identical. A cable serially connects each sequencer circuit in series to the alarm signal detecting circuit. Each sequencer circuit also modifies an alarm signal which is received along the cable, before transmitting it further along the cable to the next sequencer. As a result, the unique form of alarm signal detected, associated with each sequencer, is the identical alarm signal transmitted from each sequencer, modified by as many sequencers as are serially connected between the transmitting circuit originating the alarm signal and the circuit for detecting the alarm signal.

Preferably the originally transmitted alarm signal consists of a predetermined number of pulses. Each sequencer circuit in series is adapted to delete one of the pulses. The circuit for detecting the alarm signal is adapted to count the number of pulses received, the number being designative of the corresponding one or group of seed flow detectors which orignally transmitted the full number of pulses.

Clearly only a single cable having a minimum number of wires is required to connect the sequencers in series with each other to the alarm detecting circuit. The indicated alarm output signal depends only on the number of transmitting circuits (sequencers) in series, and not on any particular coded signal associated with each. Each sequencer is the same, the system is simple to connect, and the results are easy to interpret by the operator. Since the sequencers are connected in series by a cable having only a very few wires, the cable is easy to protect and can be routed along edges or ledges of the seeding implement to the control unit in the cab, in contrast to prior art apparatus which utilized a multiplicity of cables or a single cable incorporating a large number of wires.

A better understanding of the invention will be obtained by reference to the detailed description below, and to the following drawings, in which.

Figures 1, 2, 3, 4:
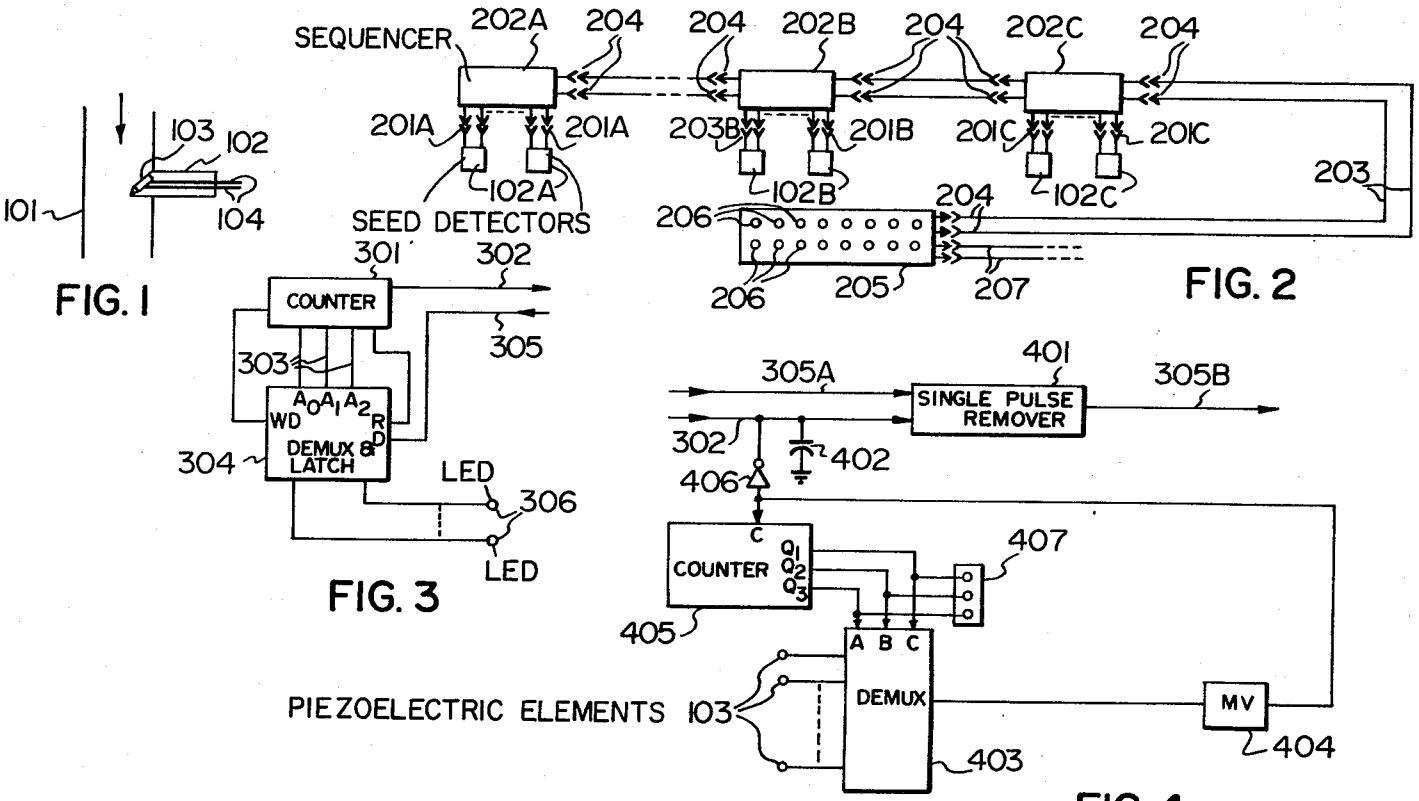
FIG. 1 is illustrations of a sectional view through a seed tube.
FIG. 2 is a diagram showing the layout of the system of the invention.
FIG. 3 is a block schematic of the pulse forming and display circuit of the control unit.
FIG. 4 is a block schematic of one of the sequencers used in FIG. 2.

A seeder is normally comprised of one or more bins which contain seeds to be planted in the field, with pipes for carrying the seeds from the bins communicating with seed tubes, each connected to a row to be planted. In order to determine that seeds are passing through each of the seed tubes, and that they have not become clogged, each seed tube 101 includes a seed detector 102 as shown in FIG. 1. The seed detector contains a piezoelectric element 103 angled toward the source direction of the seeds (the flow direction shown by an arrow) in order that a proportion of the seeds passing through the seed tube is able to strike the piezoelectric element. As a result a pair of wires 104 connected to the piezoelectric element 103 carries pulses produced when the seeds strike the piezoelectric element. The present invention is concerned with the detection of the cessation of pulses from piezoelectric element 103 (or an equivalent seed detector) or detection of the number of pulses dropping below a threshold number.

FIG. 2 shows a generalized layout of the invention on which one of the major features of the invention may be seen.

The seed detectors are grouped into groups 102*a*, 102*b*, 102*c*, etc., and are connected via corresponding connector links 201*a*, 201*b*, 201*c*, etc. to sequencers 202*a*, 202*b*, 202*c*, one sequencer being associated with each group of seed detectors.

The sequencers are connected in series via a four-wire cable, two wires carrying power and two wires carrying signals. The four-wire cable 203 (only the two signal wires being shown for clarity) utilizes connectors 204 to interconnect the sequencers in series, whereby one or more can be detached from the series link, without disturbing the remaining sequencers, the broken link being connected in series.

The cable 203 is also connected to a control and display unit 205, which carries a plurality of display indicators such as lights 206, each light corresponding to the series position of one of the sequencers.

In order to accommodate a larger number of seed tubes, two pairs of series circuits can be used, each similar to the one just described. A second cable 207 is shown connected to control and display unit 205 which connects to sequencers in a circuit similar to cable 203 being connected to sequencers 202*a*, 202*b*, 202*c*, etc. Thus each one of the upper row of lights 206 corresponds to one of the sequencers shown in FIG. 2, and each one of the lower row of lights corresponds to each one of a similar series of sequencers, not shown.

In a successful prototype, eight sequencers in each series circuit were used, with six seed detectors connected to each sequencer, giving a total of 48 seed tubes monitored in one series circuit, and 48 seed tubes monitored in the second series circuit, for a total of 96 seed tubes monitored. This prototype clearly demonstrated the utility of the invention in detecting large numbers of seed tubes, e.g. in seeders capable of seeding at least 96 rows at a time. However it should be noted that the present invention is not limited to six seed detectors per sequencer or 8 sequencers per series; other numbers can be used as will become evident below. Greater or fewer numbers can be provided for, depending on the nature of the signal carried by the cable interconnecting the sequencers and the control and display unit.

It should be noted that there are particular advantages obtained by the use of the present invention. The first advantage is that a light, easily flexed interconnection cable is used which contains only four conductors. Thus the cable can be easily bent along protected routes from the control and display unit to the sequencers. Prior art designs required at least one wire and ground to be brought from each sensor to a control unit; clearly there would be, in a 96 seed tube unit, at least 97 or possibly as many as 92 wires externally connected to the control unit. Clearly even the bending of a cable of this size a formidable tank without the liklihood of breakage of one or more of the wires. If one of the wires should break, the entire cable must be replaced, or auxiliary or redundant additional wires would have to be used to replace the broken wires. The use of a light and flexible cable substantially reduces these aforenoted problems.

In the present invention any unreliable or nonfunctioning seed detector can be unplugged substituted by a jumper to ground, and will be ignored by the control and display unit. Further, any of the sequencers can be bypassed, which bypass is automatically compensated for in the control and display unit. For example, in a sequence of 3 sequencers, normally a blocked seed detector connected to the second sequencer in series from the control and display unit will cause the second display light 206 in the control and display unit 205 to illuminate. If the second sequencer is faulty, or not used, the operator can bypass it by disconnecting the sequencer and jumpering the series cable from the first to the third sequencer. Detection of a blocked seed detector associated with the third sequencer (now the second sequencer in series) will illuminate the same second light as before. Since the operator knows that the second sequencer is not connected, once an alarm has been indicated he merely counts the number of sequencers from the control unit corresponding to the light number.

The invention operates as follows. The control unit transmits repetitively a sequence of pulses on one of the wires of cable 203, e.g. 8 pulses followed by a constant level signal. This signal is applied from cable 203 to all sequencers in parallel.

In the event that a particular sequencer has detected that seed is not passing down a seed tube associated with it by monitoring the output of its associated seed detectors, it applies the same pulse signal or the signal with one pulse subtracted to the second wire of cable 203. As the signal passes back through each successive sequencer toward the control and display unit, each sequencer in turn removes the first or leading pulse of the pulse train presented to it. The control and display unit 205 counts the remaining pulses received on the second wire, and illuminates one of the alarm lights 206 corresponding to the count.

For example, if the first sequencer has detected a blocked seed tube associated with one of its seed detectors, eight pulses are returned to the control and display unit, and the first alarm light 206 is illuminated. If the second sequencer has detected a blocked seed tube, eight pulses are applied to the second wire, one pulse is removed by the first sequencer in series as it passes to the control and display unit, resulting in seven pulses being returned to the control and display unit. The second alarm light as illuminated.

Of course within the scope of the invention each sequencer can be designed to remove more than one pulse from the sequence, if desired.

In the successful prototype noted earlier, eight pulses were used, accommodating eight sequencers. However a larger or smaller number of pulses can be used to accommodate a larger or smaller number of sequencers, depending on the design size of the system.

FIG. 3 is a block schematic of the control and display unit. A counter 301 connected to a clock (not shown) outputs a sequence of pulses on lead 302, which corresponds to one of the wires in cable 203 of FIG. 2. Preferably counter 301 is a binary counter, with other outputs providing address pulses on leads 303 which are connected to the address inputs A0, A1, and A2 of a demultiplexer and latch 304. One of the outputs of counter 301 is connected to a reset input of demultiplexer and latch 304; as counter 301 continuously cycles, demultiplexer and latch 304 is continuously addressed with sequentially increasing addresses (assuming a 3 bit address) and reset. The addresses correspond to the indicator lights.

The alarm signal is received on lead 305, corresponding to the second lead of cable 203. Lead 305 is connected to the data input D of demultiplexer and latch 304.

Assuming that a seven pulse alarm signal is received on lead 305, the pulse count resulting from the particular address input at the time the demultiplexer and latch is enabled at its write disable WD input from a predetermined output of counter 301 identifies the indicator light which is illuminated.

Thus demultiplexer and latch 304 is enabled during the counting period, that is, the maximum reception period for the eight pulses on lead 305. The address of the last pulse received is latched. The indicator light display, such as a plurality of light emitting diodes 306, is connected to the output of demultiplexer and latch 304. Thus the last pulse in the received sequence latches the address of one particular light emitting diode 306, causing illumination thereof.

A predetermined time period later, in the steady state period between pulse sequences, the demultiplexer and latch is reset, causing the operated light emitting diode to be extinguished. A further sequence of eight pulses is then applied to lead 302, and the alarm sequence of pulses is again received on lead 305 as described above. The same light emitting diode is thus illuminated. As a result the indicated light emitting diode continuously blinks on and off, alerting the operator to a blocked or inoperative seed tube (or a seed tube having a seed flow rate lower than a predetermined rate).

FIG. 4 is a block diagram of a sequencer. Lead 305A carries the pulses from earlier sequencers (or is left unconnected if the present sequencer is the last in series), and is connected to a single-pulse remover 401. The resulting signal is applied to lead 305B. Lead 305B is connected to the input lead 305A of the single-pulse remover in the next sequencer in series, and soon, or to lead 305 of the control and display unit 205.

The pulse trains originating at the control and display unit on lead 302 are applied in parallel to all sequencers. In the sequencer shown in FIG. 4, the eight pulses (in the preferred embodiment) are applied to the single pulse remover 401 which applies it directly to lead 305B in the case of an alarm in the circumstances to be described below.

The sequence of pulses is also applied to a capacitor 402 which is connected between lead 302 and ground. Capacitor 402 is continuously charged by the pulses applied from lead 302, but is also continuously discharged under normal operating conditions; thus the voltage on the capacitor remains low and the sequence of pulses cannot be applied to lead 305B. However in the case of an alarm condition, e.g. a blocked or inoperative seed detector, capacitor 402 is allowed to charge up, thus enabling the application of the pulse sequences to lead 305B.

Thus all pulses of a sequence of pulses from lead 302 are applied direction to lead 305B in an alarm condition, but pulses arriving from lead 305A have the first or leading pulse removed and the remainder are applied to lead 305B.

The piezoelectric elements 103 are each connected to a corresponding input of a demultiplexer 403. Demultiplexer 403 is adapted to scan the outputs of piezoelectric elements 103 according to address input signals applied to its address inputs A, B and C, applying their corresponding output signals in sequence to a monostable multivibrator 404. The output of monostable multivibrator 404 is connected to lead 302 through inverting buffer 406. Consequently output pulses from the demultiplexer 403 which are applied to multivibrator 404, which operates at a rate which discharges capacitor 402 continuously.

The output of monostable multivibrator 404 is also connected to the clock input of a binary counter 405. The outputs Q1, Q2 and Q3 of counter 405 are connected to the address inputs A, B and C of demultiplexer 403. Since it is undesirable to also have the pulses on lead 302 applied to the clock input of counter 405, the output of monostable multivibrator 404 is connected to lead 302 through buffer 406.

In operation, seeds will normally pass along the various seed tubes in which piezoelectric elements 103 are fixed. One of the piezoelectric elements 103 is scanned by demultiplexer 403, and the resulting pulses cause operation of multivibrator 404. When the output of multivibrator 404 goes to high level, it is inverted in buffer 406 to low level. Pulses from the control and display unit on lead 302 applied to charging capacitor 402 are discharged by the low level intervals at the output of buffer 406.

When each pulse from the output of multivibrator 404 is applied to the clock input C of counter 405, it changes its address output signal which is applied to demultiplexer 403. The changed address in demultiplexer 403 causes the scanning of a second piezoelectric element 103, and which is connected to the addressed output lead of demultiplexer 403. Assuming that seeds are at this time passing through an associated seed tube, the second piezoelectric element emits pulses which cause operation of multivibrator 404, which has by now reverted to its low level output state following its previous pulse. Multivibrator 404 is again caused to output a pulse going to high level, repeating the sequence described above. In this manner demultiplexer 403 scans each piezoelectric element in sequence; assuming seeds are flowing in each associated seed tube, multivibrator 404 operates continuously, causing continuous operation of counter 405 and sequencing of the piezoelectric element input address to demultiplexer 403. At the same time capacitor 402 is continuously discharged.

In the event that there is no output from one of piezoelectric elements 103, which would result from seeds not passing down its associated seed tube multivibrator 404 does not operate when the element is scanned. The output of the multivibrator remains at low level. Consequently counter 405 is not clocked and its output is not advanced. As a result the address input to demultiplexer 403 is not advanced, and no further scanning occurs.

However when the output of multivibrator 404 remains at low level, the output of buffer 406 goes to high level or follows the signal level on lead 302. Consequently capacitor 402 charges and the signal level on lead 302 is applied to single pulse remover 401.

Single pulse remover 401 applies the signal received from lead 302 directly to lead 305B. In the alternative, in an alternative design, the first pulse can be removed, if this is accounted for in the control and display unit described earlier. The resulting output signal from single pulse remover 401 is carried by lead 305B to lead 305A connected to the next sequencer signals pulse remover, in which a pulse is removed and the remaining signal applied to lead 305B, and so on to the remaining sequencers in series toward the control and display unit 205. Here the pulses are counted as described earlier and one of the display light emitting diodes is lit, alerting the operator that one of the seed tubes associated with the indicated sequencer is not functioning.

Since the counter 405 has stopped, the operator can now determine which seed tube is inoperative. Each of the leads connected to address inputs A, B, and C is connected to a test plug 407. The operator need merely monitor the high or low level state of the leads connected to the test plug and obtain the address of the demultiplexer input, which indicates which particular seed tube has caused the alarm.

It should be noted that alternative circuits for applying the pulse signal to lead 305B can be used. For example capacitor 402 can be charged from a d.c. power source, and can be continuously discharged by multivibrator 404 as in the embodiment described above. The voltage level across capacitor 402 can be applied to the enable input of a gate which has lead 302 connected to its input. The output of the gate can be connected to lead 305B. Thus in the absence of pulses from multivibrator 404 the voltage across the capacitor is allowed to rise, allowing the threshold of the gate to be exceeded, allowing the pulses from lead 302 to be applied to lead 305B.

Figure 5A:
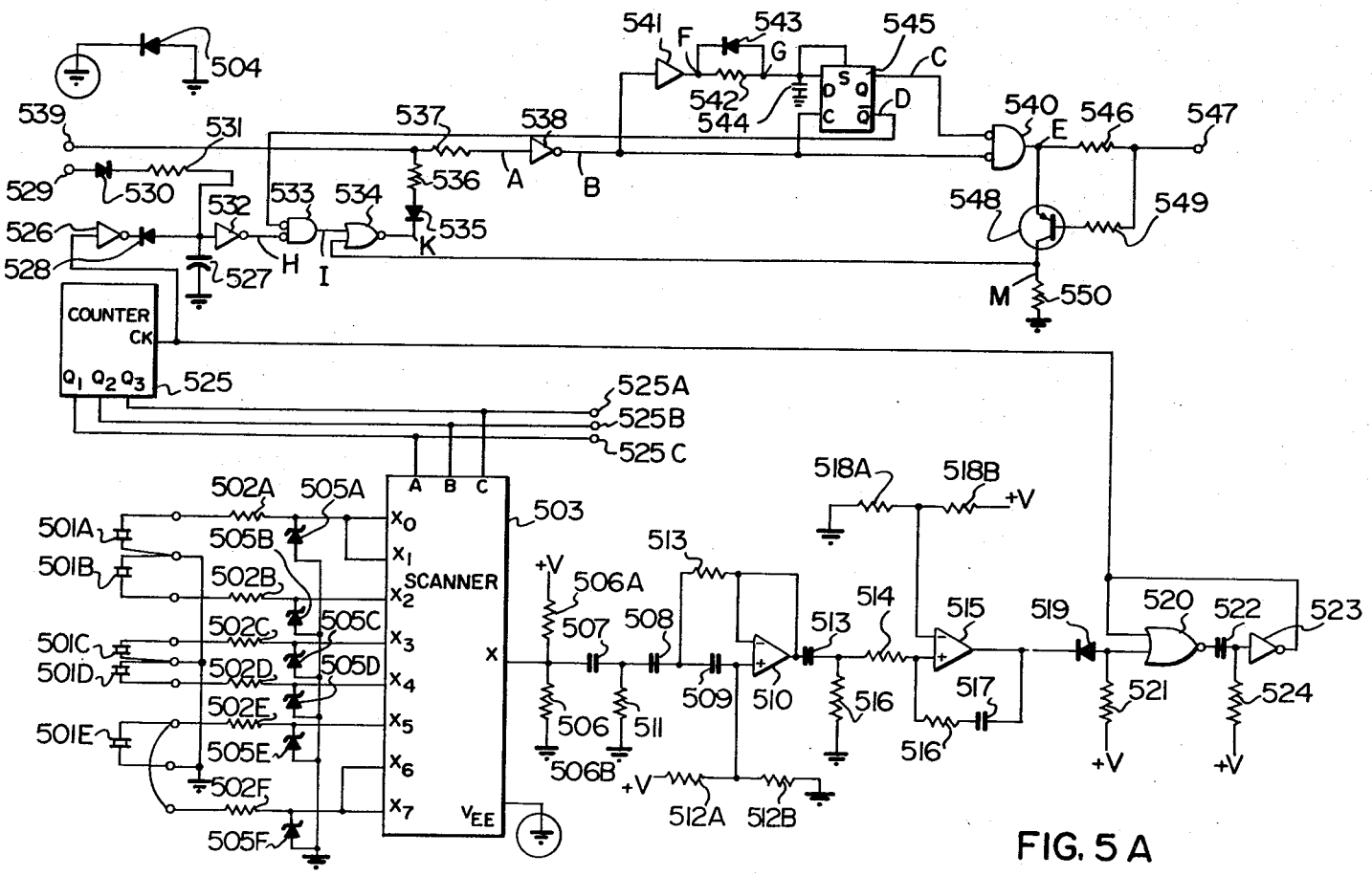
FIG. 5*a* is a schematic diagram of the sequencer having waveforms of FIG. 5*b*.

FIG. 5A is a detailed schematic diagram of the sequencer portion of the invention. Representative five piezoelectric crystal elements 501*a*–501*e* are each connected between local ground and a corresponding resistor 502*a*–502*e*. Each of the resistors is connected to a corresponding input of a demultiplexer 503. Demultiplexer 503 preferably has eight inputs X0–X7, each of which can accommodate a piezoelectric crystal element. Only five such elements are shown to illustrate how unused demultiplexer inputs should be connected. Demultiplexer input X0 is connected to resistor 502*a*, and unused input X1 is connected to input X0. Thus the same signal which appears at input X0 appears at input X1. Inputs X6 and X7 are similarly connected together. Thus 6 of the 8 demultiplexer inputs are capable of receiving an input signal. Inputs X6 and X7 are connected through resistor 502F to a terminal to which a piezoelectric crystal element would have been connected. In the case in which an element has been removed as in this example, the terminal connected to resistor 502F is jumpered across to piezoelectric element 501E. Therefore inputs X5, X6 and X7 all receive the same signal, from piezoelectric element 501E. In general, if a piezoelectric element is removed, its terminal not connected to ground should be jumpered to the live terminal of another piezoelectric element, preferably the next earlier one in the scanning cycle. If one of the inputs of demultiplexer 503 is left unconnected or connected to ground, an alarm indicating malfunction of a piezoelectric element at that input will be given.

The $V_{EE}$ input of demultiplexer 503 is connected to true ground, with respect to the control and display unit. The piezoelectric crystal elements are connected, however, to local ground. Local ground is connected to true ground through diode 504, which has its anode connected to local ground, thus rendering local ground about 0.7 volts about true ground.

Zener diodes 505A–505F are connected between corresponding inputs of demultiplexer 503 and local ground. Due to the threshold of the zener diodes in the forward direction, their cathodes can be 0.7 volts above ground, for the inputs of a CMOS type demultiplexer. It is therefore necessary to provide a ground connected to their anodes (local ground) which is 0.7 volts above the true ground to which the multiplexer VEE input is connected.

As the seeds pass down the seed tubes, they strike the corresponding piezoelectric crystal elements, which generate output voltage spikes in response, which be in excess of 6 volts. The zener diodes 505A–505F load down the crystal to reduce the voltages and the impedance, and resistors 502A–502F limit the current flowing into the corresponding Zener diodes, protecting them from excess current flow.

Demultiplexer 503 sequentially scans each of the inputs, as designated by the binary address signal applied to address inputs A, B and C. The voltage spikes from each of the piezoelectric crystal elements in turn are applied to output terminal X of demultiplexer 503.

A voltage divider comprising resistors 506A and 506B connected between a source of voltage +V and local ground, has the junction of the resistors connected to the output of the demultiplexer, and established a d.c. bias voltage level to the mid-range of the zener diodes, typically 2–3 volts. Resistors 506A and 506B also provide loading for small signals from the crystal elements.

The d.c. biased output signal of the demultiplexer is then applied to a high pass filter, preferably of Butterworth form, for rejecting signals below 10 Khz. which typically is the frequency at which extraneous vibration is manifested. The filter used in one successful prototype of the invention was comprised of series capacitors 507, 508 and 509 connected between output X of the demultiplexer to the non-inverting input of an operational amplifier 510. The junction of capacitors 507 and 508 is connected through resistor 511 to local ground. The non-inverting input of operational amplifier 510 is connected to the junction of two resistors 512A and 512B which form a voltage divider which is connected in series between a source of potential +V and local ground. The output of operational amplifier 510 is connected back to its inverting input and through resistor 513 to the junction of capacitors 508 and 509.

The output of operational amplifier 510 is connected through coupling capacitor 513 in series with resistor 514 to the non-inverting input of a comparator 515. The junction between capacitor 513 and resistor 514 is connected to local ground through resistor 516 and the non-inverting input of comparator 515 is connected through resistor 516 in series with capacitor 517 to the output of comparator 515. The inverting input of comparator 515 is connected to the junction of a pair of resistors 518A and 518B forming a voltage divider, connected in series between potential +V and local ground.

The comparator performs two functions. It amplifies with high gain to full logic level for the NOR gate to follow, and provides a threshold whereby signals greater than about 50 to 100 millivolts can pass, and those signals which are less are blocked. This, along with the low impedance feed obtained by the use of zener diodes 505A–505F, eliminates cross-talk between the crystal element channels, which might otherwise give false indications that a non-functioning seed tube is indeed functioning.

The output signal of comparator 515 thus is comprised of squarewaves at the frequency emitted by each piezoelectric crystal, which signals are above 50–100 mv, and below 10 KHz. Typically these square wave periods have been found to have periods of about 20 microseconds.

The output signal from comparator 515 is applied through buffer diode 519 to the input of a monostable multivibrator of conventional construction. The multivibrator used in the aforenoted prototype was comprised of NOR gate 520 having one input connected to receive the output signal from the comparator, that input also being connected to potential +V through resistor 521. A capacitor 522 is connected between the output of NOR gate 520 and the input of an inverting buffer 523. The input of buffer 523 is connected to potential +V through a resistor 524. The output of inverting buffer 523 is connected to the second input of NOR gate 520.

In operation, the signal input of NOR gate 520 is held at high potential +V. However when the output of comparator 515 goes low, causing diode 519 to conduct, the input of NOR gate 520 goes low, initiating operation of the multivibrator. The period of the multivibrator is preferably about 5 milliseconds, which is set by the time constant of capacitor 522 and resistor 524. However it will be seen that if the rate of flow of seeds down the seed tubes is slow, the multivibrator is enabled at less frequency times, and thus its rate of operation below a given rate of seed flow is related to the seed flow rate.

The output of the multivibrator is connected to the clock input CK of binary counter 525. As the monostable multivibrator outputs a pulse of about 5 milliseconds long, binary counter 525 is clocked and is caused to advance its count output signal at outputs Q1, Q2 and Q3. These outputs are connected to the address inputs A, B and C of demultiplexer 503. Thus demultiplexer 503 addresses its input which has e.g. the first piezoelectric crystal element 501A, and connects it to output X. When seeds passing down an associated seed tube hit crystal element 501A, one or more generated voltage spikes are passed through the filter, the comparator, and cause operation of the monostable multivibrator. An output pulse is produced from the multivibrator, the trailing edge of which clocks the binary counter 525. The outputs Q1, Q2 and Q3 advance their count output signal, advancing the address input signal applied to inputs A, B and C of demultiplexer 503 so that the signal at input X0 is applied to the output X. The process repeats itself, and thus at approximately 5 millisecond intervals the demultiplexer sequentially scans each piezoelectric element.

In the event a seed tube is blocked, there will be no output signal from the corresponding piezoelectric element. Consequently the monostable multivibrator will not output a clock pulse to binary converter 525, and the demultiplexer scans no further than the faulty crystal, since the input address is not advanced further. In order to determine which piezoelectric element, and thus which seed tube is faulty, an operator can connect a binary decoder with a display to test terminals 525A, 525B and 525C which connect to corresponding address inputs A, B and C of the demultiplexer. The signal code at the test terminals thus indicates the address of the faulty seed tube.

It will be recognized that the crystals 501A–501E are high impedance devices, and the leads connected thereto would be subject to transient interference and crosstalk from adjacent crystals, vehicle ignition, etc. Zener diodes 505A–505F, biased slightly into their conducting condition, with low resistance resistors 502A–502F (e.g. 100 ohms each) provide a heavy low impedance load on the piezoelectric elements. Therefore the signals appearing at the input of the demultiplexer are representations of output current from the piezoelectric elements, rather than output voltage. Sensing the current through low impedance lines minimizes substantially the effect of cross-talk, ignition voltage spike pick-up, etc. The leads to the crystals can be long, and advantageously in most cases need not be shielded.

The output signal from the monostable multivibrator, which, if present, is an indication that all seed tubes connected to demultiplexer 503 are functioning properly, is applied through inverting buffer 526 to one terminal of capacitor 527 through diode 528. Diode 528 is poled such that when the output of the monostable multivibrator is at the high level portion of its portion of its pulse, diode 528 is forward biased, and charge stored by capacitor 527 is discharged.

Groups of eight positive-going pulses from the control unit, separated by a low level gap, are applied to input terminal 529. The anode of diode 530 is connected to input terminal 529, and its cathode is connected through resistor 531 to the junction of the anode of diode 528 and capacitor 527. Diode 530 effectively buffers the input signal, and together with high valued resistor 531 protect similar terminals on other sequencers receiving the 8 pulse input signal in parallel, from being loaded to any significant extent.

The 8 pulse input signal is thus applied to capacitor 527, and would otherwise charge the capacitor, except that capacitor 527 is continuously being discharged by the output signal from the monostable multivibrator as described earlier. However if a non-functioning seed tube causes cessation of the operation of the multivibrator, capacitor 527 begins to charge and eventually follows the voltage level of the input pulses. The voltage level across capacitor 527 is applied to the input of an inverting buffer 532.

Clearly the output of inverting buffer 532 would always be at high level when all seed tubes are functioning normally. However in the case of an alarm, its output follows the pulse input signal, going to low level for each pulse and to high level in the gap between the eight pulse groups. This signal is applied to one input of an inverting logic AND gate 533. Assuming the other input of AND gate 533 is at low level, the input pulse signal is inverted to high level at its output, and is applied to one input of NOR gate 534. Assuming the other input of NOR gate 534 is high, a low level output signal is produced, and is applied to the cathode of diode 535, which has its anode connected through resistor 536 in series with resistor 537 to the input of inverter 538. The output of NOR gate 534, which is normally at high level, outputs low level pulses to the input of inverter 538. Diode 535 buffers terminal 539 which is connected to the junction of resistors 536 and 537.

Figure 5B:
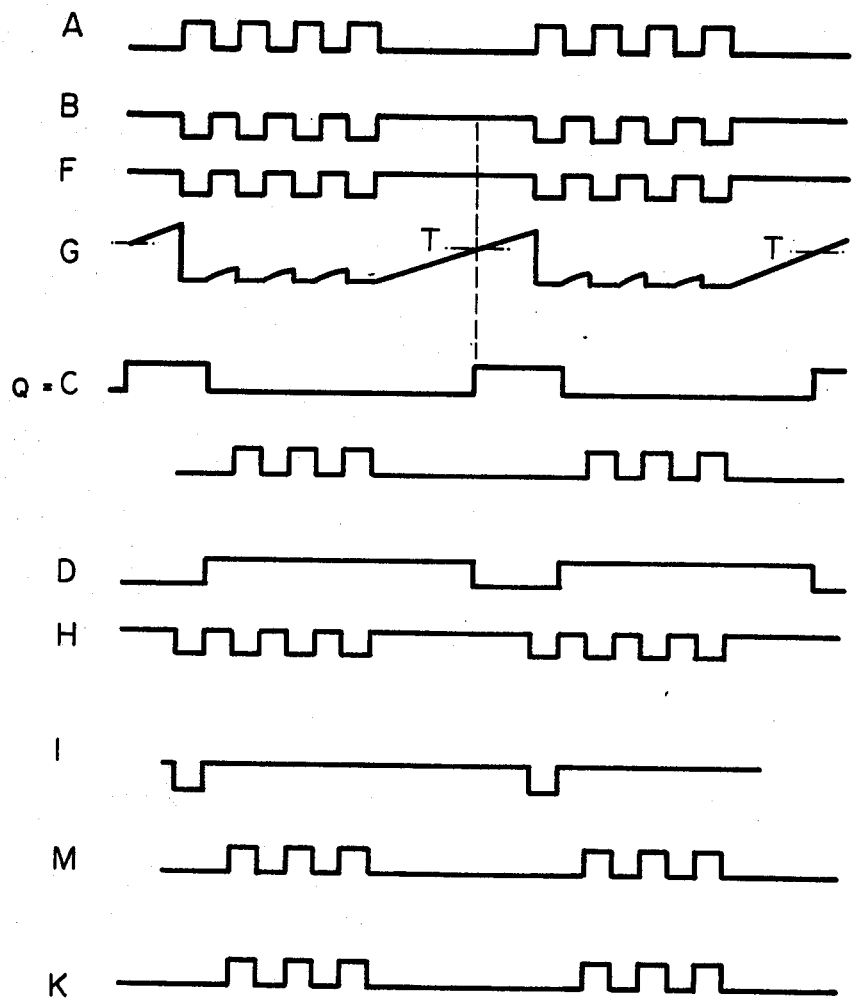

The following circuit will be described with the aid of FIG. 5B. For the case of this example, groups of 4, rather than 8 pulses will be used, which is sufficient to illustrate the principles involved.

Assume that groups of four pulses are applied to terminal 539. These pulses appear as waveform A in FIG. 5B. The pulses pass though resistor 537 and are inverted in inverter-buffer 538 and appear as waveform B at point B in FIG. 5A. This signal is applied to one of the two inverting inputs of AND gate 540 (an inverted logic AND gate).

The signal at point B is also passed through a buffer amplifier 541 and appears as waveform F at point F.

Connected to the output of amplifier 541 are a resistor 542 in parallel with a diode 543 (the diode having its cathode connected to the output of amplifier 541), their other terminals being connected to capacitor 544 at point G which is also connected to local ground. Capacitor 544 is caused to charge with a time constant established by resistor 542 and capacitor 544 when the signal at point F is positive, and to discharge rapidly through diode 543 when the signal at F is at ground or low level. This signal at point G therefore takes the form of waveform G. During the positive-going pulse periods of waveform F, there are small increases in amplitude at point G, while during the period between pulse groups, the voltage on capacitor 544 continues to rise substantially. As soon as the first negative-going pulse of the train of 4 pulses appears at point F, capacitor 544 discharges rapidly and point G goes to low level.

Capacitor 544 is connected to the data input D of a flip flop 545. The threshold of input D is at amplitude level T, shown in FIG. 5A waveform G. Flip flop 545 thus changes state when its clock input C is at high level while the signal applied to the data input is above the T threshold.

The output of inverter 538 is connected to the clock input of flip flop 545. Thus the Q output of flip flop 545 provides the signal level shown in waveform C at point C in FIG. 5. When the amplitude of waveform G applied to the data input of flip flop 545 reaches the threshold, waveform B is at high level between the pulses. Accordingly the flip flop changes state to the state of the data input, which is at high level; the Q output changes to high level as shown in waveform C.

The flip flop retains its state until the clock input has a leading edge going to high level again, which is at the trailing edge of the first pulse in the originally applied group of 4 pulses. However at this point waveform G at the data input is at low level, capacitor 555 having been discharged rapidly with the leading edge of the first pulse. Accordingly the flip flop changes state, and the Q output goes to low level, as shown in waveform C. Waveform D shows the output signal at the $\overline{Q}$ output of flip flop 545.

The Q output of flip flop 545 is also connected to the second inverting input of inverted logic AND gate 540. The output of gate 540 goes to high level when each of its inputs are at low level, as shown in FIG. 5B as waveform E. This waveform is the inverse of the combination of waveforms B and C going to low level. It may be seen that since waveform C extends during the interval of first pulse of the train of 4 pulses, the first pulse is detected, and the remaining pulses are produced at point E of FIG. 5. The circuit described above thus absorbs the first pulse of each pulse train, transmitting one fewer than the number originally presented.

The signal at point E is applied via resistor 546 to output terminal 547. Terminal 547 is connected to the corresponding input terminal 539 of the next sequencer in series. The next sequencer deletes the first pulse of the pulse train applied to it as described above, transmitting on one fewer than the number of pulses applied to it. The final sequencer in series applies the remaining group of pulses to the control and display unit. In this manner different numbers of pulses are applied to the control and display unit, depending on which sequencer in series has indicated the alarm, the larger the number of sequencers, the smaller the number of pulses. It may be seen that removing a sequencer from the series of sequencers has only the effect of shifting the count indication of the remaining sequencers in the series away from the control and display unit.

Returning now to FIG. 5*a*, the emitter of a PNP transistor 548 is connected to the junction of the output of AND gate 540 and resistor 546 and its base is connected through resistor 549 to the other terminal of resistor 546. The collector is connected through a load resistor 550 to local ground, and to the second input of NOR gate 534. The $\overline{Q}$ output of flip flop 545 is connected to the second input of AND gate 533.

It may be seen that once capacitor 527 has become fully charged, all of each group of pulses is applied to the input of AND gate 533 and the resulting signal appears at point A, in FIG. 5. Transistor 548 is a current detector which repeats the signal at the output of AND gate 540 and applies it to NOR gate 534. As a result the first pulse of each group applied from the control and display unit at terminal 529 is absorbed by the circuit described above.

Thus the blockage of one of the seed tubes, results in cessation of the generation of pulses from associated piezoelectric crystal detectors. This results in the application of groups of pulses, each group having a predetermined number of pulses, to an output line, the number of pulses being the same for each sequencer. Each sequencer transmits the applied pulses to the control and display units in series, each sequencer in series subtracting one pulse in the process. The number of pulses arriving at the control and display is thus indicative of the particular sequencer which has detected the faulty seed tube. Application of a binary counter and display to a group of test terminals allows the detection of the particular seed tube in which the seed has stopped flowing.

Figure 6:
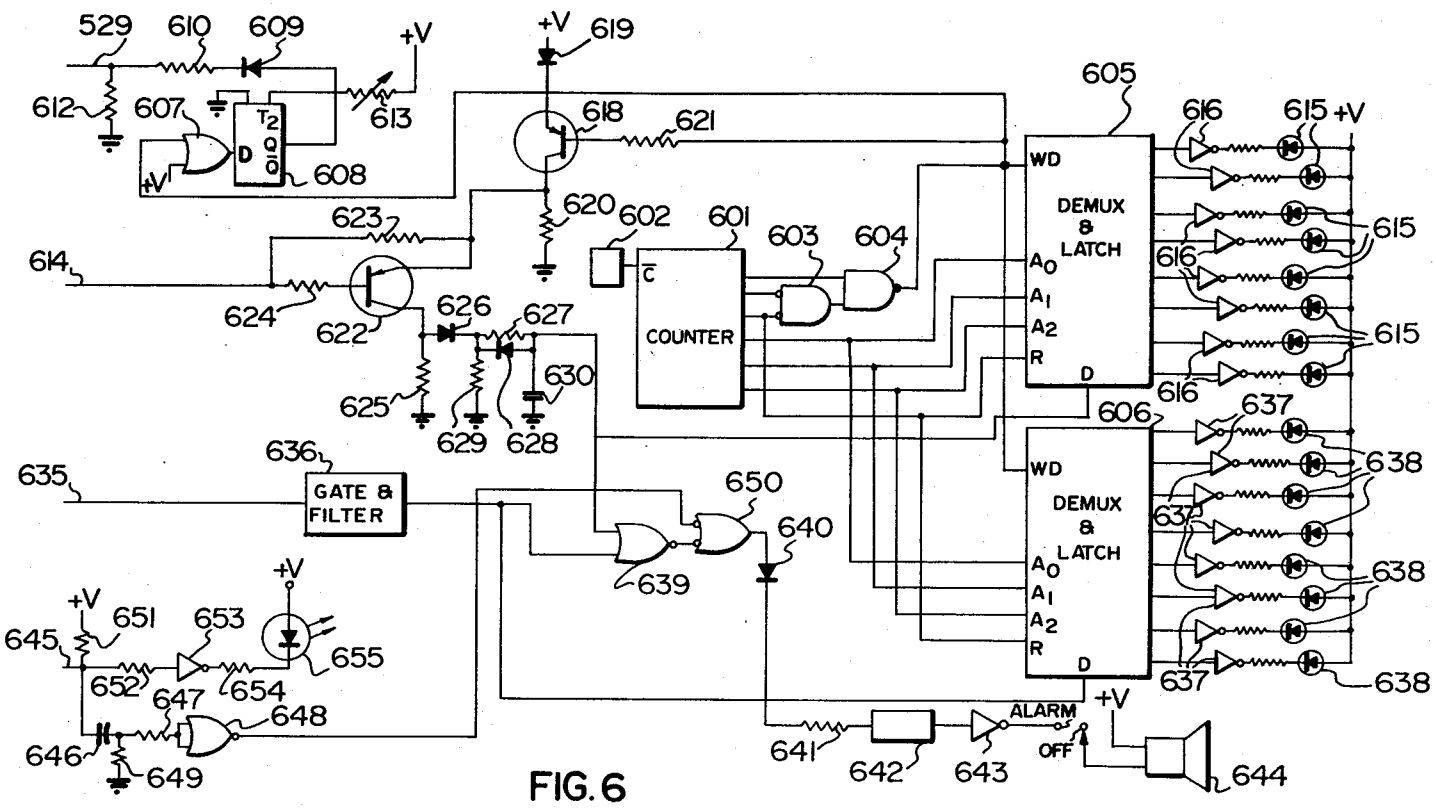
FIG. 6 is a schematic diagram of the control and display unit.

Turning now to FIG. 6, a preferred form of the control and display unit is shown in detail. The clock input $\overline{C}$ of binary counter 601 is connected to a clock source 602, being an oscillator of conventional construction. Three of the outputs of the binary counter are combined to provide eight output pulses followed by a gap of eight pulses at low level. Two of the outputs are connected to the inputs of inverting logic AND gate 603, the output of which is connected with the third binary counter output to the input of NAND gate 604. The output of NAND gate 604 is connected to a repeater, i.e. to the input of OR gate 607 (operated as a buffer) the output of which is connected to the data input of flip flop 608. The Q output of flip flop 608 is connected through an isolation diode 609 in series with resistor 610 to the output lead or terminal 529. Output lead or terminal 529 is bypassed through resistor 612 to ground.

One of the timing inputs T2 of flip flop 608 is connected through variable resistor 613 to a source of potential +V.

As oscillator 602 applies square waves to the $\overline{CI}$ input of binary counter 601, it produces at the output of NAND gate 604 a continuous sequence of eight pulses followed by an eight pulse period low level interval. This signal is applied to flip flop 608 which repeats the signal through diode 609 to the output lead or terminal 529.

Resistor 613 allows the variation of the reset period of flip flop 608, thus effectively varying the pulse width of each pulse passing therethrough. The pulse sequence is applied to terminal 529 (FIG. 5A), and would charge capacitor 527 (which itself is continuously discharged at a rate related to the rate at which seeds passing down the seed tubes hit the piezoelectric crystals below a certain flow rate). In other words, if the rate of delivery of seeds down the seed tubes is low, the rate of discharge of capacitor 527 is reduced, and for a given signal pulse width received on lead 529, the fewer the seeds passing down the seed tubes, the more chance there is for capacitor 527 to charge above the T threshold (FIG. 5B, waveform G) and indicate an alarm. The pulse width of the signal applied to terminal 529 can thus be used as a control for an alarm indication that the rate of seed delivery has passed below a certain threshold. For a wide pulse width, capacitor 527 would charge faster, and thus a high seed delivery rate would be necessary to discharge capacitor 527 fast enough so that an alarm is not initiated. Conversely, to accommodate a low seed delivery rate, the pulse width of the signal applied to terminal 529 should be made narrower, thus causing capacitor 527 to charge more slowly. Variable resistor 613 thus serves as a seed feed rate monitor control, and preferably should be calibrated as such. Upon setting this control at a particular rate, should the seed feed rate drop below this value, an alarm is indicated, indicating the sequencer to which the seed tube which is delivering at a lower rate is connected.

The return alarm signal from the series of sequencers described earlier is received on lead 614, and is carried to the data input D of demultiplexer and latch 605. Three of the outputs of binary counter 601 are connected to the address inputs A0, A1 and A2 of demultiplexer and latch 605 to indicate the address of the received data pulses. The output of NAND gate 604 is connected to the WRITE DISABLE input WD of demultiplexer and latch 605, allowing the demultiplexer and latch to be enabled during the pulse emission and reception period. When an alarm occurs, pulses are received at the data input of demultiplexer and latch 605, and an output terminal is determined by the address of each received pulse established by the count output of binary counter 601. Thus an output is enabled corresponding to each address corresponding to each received pulse, the last output, for the last pulse being latched for the period until the demultiplexer and latch 605 is reset.

The outputs of demultiplexer and latch 605 operate an indicator display, such as a group of light emitting diodes 615, each of which is connected via a corresponding buffer 616 and resistor 617 to an output of demultiplexer and latch 605. One of the outputs of binary counter 601 is connected to the reset R input of demultiplexer and latch 605. Just prior to the transmission (and thus the reception) of the first pulse of the second group of eight pulses (of course not all of which would be received) demultiplexer and latch 605 is reset, thus causing the illuminated light emitting diode 615 to extinguish. Since it takes eight pulse periods from the time of shut off to the time of latching of the last data pulse from lead 614, and since the light emitting diode which is illuminated stays on for about eight pulse period times, the light emitting diode indicating the alarm blinks on and off with approximately equal periods. The blinking light emitting diode corresponds to the number of the last return pulse in the returned group.

It is thus clear that the particular light emitting diode 615 which illuminates and blinks, indicates the number of sequencers in series with the one which has indicated the alarm.

Since the return lead 614 from the series of sequencers may contain noise, it is preferred that the return lead feeding data to demultiplexer and latch 605 should not become active except during the pulse periods. Therefore a current detector is provided which includes PNP transistor 618 which has its emitter connected through diode 619 to a source of potential +V, its collector connected to local ground through resistor 620, and its base connected through resistor 621 to the pulse signal output from NAND gate 604. The collector of transistor 618 is connected to the emitter of PNP transistor 622, which is connected with the base of the same transistor through resistors 623 and 624 respectively to the return lead 614 from the sequencers. The collector of transistor 622 is connected to local ground through resistor 625, and through diode 626 to the input of a glitch filter. The glitch filter is preferably comprised of resistor 627 which is connected from the cathode of diode 626 to the data input D of demultiplexer and latch 605, and is connected in parallel with a diode 628 (connected in inverse polarity to diode 626), the junction of the cathodes of diodes 626 and 628 being connected to local ground through resistor 629, and the anode of diode 628 being connected to local ground through capacitor 630.

The aforenoted circuit applies +V operating potential to transistor 622 during the pulse periods. Transistor 622 is also effectively non-conductive between pulse periods and during the gap between pulse sequences, thus removing the possibility of extraneous noise pulses passing from lead 614 to the data input of demultiplexer and latch 605. During the pulse periods, however, transistor 622 is conductive, and will pass pulses received on lead 614, if any.

Since the pulses themselves may contain drop outs or glitches, the pulses are applied to the glitch filter described above, which smooths the form of the pulses and causes reasonably accurate square wave pulses to be applied to the data input D of demultiplexer and latch 605.

It was noted in the description with reference to FIG. 2 that a second pair of lines 203, connected to a second series of sequencers can be utilized (indeed more than two can be provided if desired). FIG. 6 shows how the second pair of lines can be accommodated.

Assuming that the second sequence of sequencers similar to the first has a return lead 635, this lead is connected to the D data input of a demultiplexer and latch 606 through a transistor-glitch filter network similar to the one described above. This network 636 operates similarly to the one described above, but for the second series of sequencers. Demultiplexer and latch 606 has its WD address and reset inputs connected in parallel with those of demultiplexer and latch 605, and its outputs are connected through buffers 637 to light emitting diodes 638. The second group of light emitting diodes 638 can be physically located on a display panel immediately below those of diodes 615, both rows shown as indicators 206 in FIG. 2.

Since the operator of the equipment will usually be distracted, controlling the operation of the vehicle, and will not notice the illumination of the light emitting diodes, it is preferred that an audible alarm should be provided to alert him to an alarm. The outputs of the glitch filters are connected to the inputs of NOR gate 639, which has its output connected in a circuit path through diode 640 in series with resistor 641 and the enable input of an oscillator 642, its output through a buffer 643 to a horn 644. Preferably the horn is connected to the output of buffer 643 through a switch which also provides an "off" position.

It is also preferred that a bin level indicator should be able to operate the alarm. A low seed bin level output signal is applied from lead 645 through large valued capacitor 646 and resistor 647 to the input of a NOR gate 648 (operated as an inverter). The junction of resistor 647 and capacitor 646 is connected to ground through resistor 649. The output of NOR gate 648 is connected to one of the inverting inputs of OR gate 650. To accommodate the latter alarm, the output of NOR gate 639 is connected to the second input of OR gate 650, the output of the latter gate being connected to the anode of diode 640.

The lead 645 is also connected to a source of potential +V through resistor 651. In operation, during an alarm the lead 645 goes to high level, i.e. to +V through resistor 651. Capacitor 646 charges, and during the charge time, a pulse is applied to the input of OR gate 650. The result is brief operation of oscillator 642, causing the horn 644 to operate during the charge time of capacitor 646, i.e., a short "beep". This indicates to the operator that the seed bit level is low.

A light emitting diode indicating the low bin level alarm preferably is also provided. The high level alarm signal is applied through resistor 652 to the inverting input of inverting buffer 653. Its output goes to low level, which low level signal is applied through resistor 654 to the cathode of light emitting diodes 655, the anode of which is connected to +V. Thus when the alarm is present, light emitting diode 655 operates and stays on. During a seed tube alarm, the oscillator is caused to operate from either of the two sequencer series during the pulse periods, creating a series of pulsating "beeps".

The bin level indicator can be a light emitting diode-photodetector pair, the output of which is applied through a logic circuit which provides a high level output when the gap between the light emitting diode and photodetector is not blocked with seeds. Indeed, a group of bin detectors (one for each bin or located at various parts of a single bin) can be logically coupled together and can provide a high level logic output indicating one or more empty bins or one or more areas of a bin empty.

Other apparatus can be used in conjunction with the present invention to provide a useful display for the operator. For instance rotating magnets can be provided on the vehicle wheels rotating with each revolution, which operate reed switches during each pass of a magnet. An output pulse can be provided which indicates the distance travelled, and with a suitable divider representative of the seeder width, provide a pulse count which is indicative of the number of acres seeded. Thus with the seed rate setting on control resistor 613, a vehicle speed rate can be set by the operator which gives him an indication of the minimum of how many seeds per acre are sown.

A person skilled in the art understanding this invention may now conceive of other embodiments or variations of the invention. However all are considered to be within the sphere and scope of the invention as defined in claims appended hereto.

The embodiments of the invention in which an exclusive property or privilege is claimed are defined as follows:

1. A seed flow monitor comprising:

(a) means for detecting the flow of seeds in a plurality of seed tubes, (b) means for transmitting a pulse signal in the event of reduction of the rate of flow of seeds in any of the seed tubes below a predetermined minimum, the pulse signal being comprised of a first predetermined number of pulses, the transmitting means being adapted to transmit the pulses via serially connected pulse signal modification means associated with each one or group of seed tubes, (c) the pulse modification means being adapted to receive a series of pulses transmitted thereto and to transmit a different number of pulses to a further serially connected similar modification means or to the central display means, the character of a resulting pulse signal representing the serial placement of one or a group of seed tubes relative to other ones or groups of seed tubes, and (d) central display means for detecting the modified pulse signal and indicating the detected reduction of the flow of seeds on a display, the indicated display corresponding to the placement of the one or group of seed tubes.

2. A seed flow monitor as defined in claim 1 in which the transmitted pulse signal is the same, regardless of which seed tube has suffered cessation of seed flow.

3. A seed flow monitor as defined in claim 2, in which the pulse signal is comprised of a first predetermined number of pulses, the transmitting means being adapted to transmit the pulses via serially connected pulse subtraction means associated with each one or group of seed tubes, the pulse subtraction means adapted to receive a series of pulses transmitted thereto and to subtract a second predetermined number thereof, and to transmit the remaining number of pulses to a further serially connected similar pulse subtraction means or to the central display means.

4. A seed flow monitor as defined in claim 3 in which the second predetermined number is one.

5. A seed flow monitor as defined in claim 3 or 4 in which the central display means is comprised of means for counting the number of pulses transmitted from a final one of the series of subtraction means and for displaying on an indicator a number corresponding to the number of pulses counted, for indicating the one or group of seed tubes in which the flow rate of seeds has reduced below said minimum.

6. A seed tube monitor comprising:

(a) a central display means including means for generating a stream of pulses, and a displaying circuit, (b) means for detecting the reduction of the rate of flow of seeds in one or groups of seed tubes below a predetermined minimum, (c) pulse receiving means associated with each one or a group of seed tubes, for receiving the stream of pulses, (d) pulse subtraction means associated with said each one or a group of said detecting means, adapted to subtract a first predetermined number of pulses from a sequence of pulses which may be applied thereto, (e) a pulse transmission line connecting each pulse subtraction means in series to the displaying circuit of the central display means, (f) means for coupling a second predetermined number of said pulses of said stream of pulses to the pulse transmission medium via the pulse stream receiving means at one or group of seed tubes upon the detection thereat of the reduction of the flow of seeds below said minimum, whereby the second predetermined number of pulses is carrier along the transmission line, said first predetermined number thereof being subtracted by each pulse subtraction means in series, (g) means at the display means for receiving a remaining number of pulses from the transmission line and for displaying a representation corresponding to the remaining number of pulses, said number corresponding to said one or group of seed tubes in which said reduction of the rate of flow of seeds has been detected.

7. A seed tube monitor as defined in claim 6, in which said first predetermined number is one.

8. A seed tube monitor as defined in claim 7 in which the means for detecting said reduction in the rate of flow of seeds is comprised of means for generating signals associated with the flow of seeds in each tube of a group of seed tubes, a demultiplexer for scanning said signals and for generating output pulses upon the detection of said individual signals, means for applying said second predetermined number of pulses to the transmission line, and circuit means for inhibiting the application of said predetermined number of pulses to the transmission line in the presence of said output pulses.

9. A seed tube monitor as defined in claim 8 in which said means for inhibiting is comprised of translation means adapted to receive and pass said predetermined number of pulses when enabled, the translation means having an enable terminal with an enable threshold, a capacitor connected to the enable terminal, means for charging the capacitor to a potential level higher than said threshold whereby the translation means is enabled, and means for applying said output pulses to the capacitor for discharging the capacitor to a potential level below the threshold whereby the translation means is inhibited, the translation means being enabled in the absence of said output pulses upon the charging up of said capacitor.

10. A seed tube monitor as defined in claim 9, including circuit means for charging said capacitor with the steam of pulses.

11. A seed tube monitor as defined in claim 11, in which the capacitor is connected across the input of said translation means, whereby the translation means is adapted to receive and pass said predetermined number of pulses when the capacitor is charged to a level higher than the threshold of the translation means.

12. A seed tube monitor as defined in claim 11, further including monostable multivibrator means for receiving said individual signals and generating lower repetion rate clock pulses in response thereto.

13. A seed tube as defined in claim 8, 11 or 12, further including a binary counter having a plurality of binary outputs, address inputs of the demultiplexer being connected to said binary outputs, whereby the input to which are connected the particular means for generating signals associated with the flow of seeds are addressed and scanned by the demultiplexer, a clock input to the binary counter, and means for applying said output pulses to the clock input of the binary counter, whereby upon the scanning of a particular individual means for generating signals and in the absence of said individual signal or the presence of a low repetion rate signal at the corresponding demultiplexer input indicating a seed flow rate in a seed tube lower than a predetermined minimum, no clock signals are applied to the binary counter and the address signal applied to the multiplexer remains constant.

14. A seed flow monitor comprising:

(a) means for detecting the flow of seeds in a plurality of seed tubes, (b) means associated with each one or groups of said detectors for transmitting an alarm signal along a transmission line upon detection of the flow of seed being below a predetermined flow rate in a seed tube, in which the alarm signal transmitted by each transmitting means as a result of said detection is identical, (c) means for detecting an unique form of the alarm signal associated with each one or groups of said detectors, (d) a cable forming said transmission line serially connecting each transmitting means in series to the alarm signal detecting means, (e) means at each transmitting means for modifying an alarm signal which may be received along the cable before transmitting it further along the cable, to provide an unique form of alarm signal comprised of said identical alarm signal modified by as many transmitting means as there are serially connected between the transmitting means originating the alarm signal and the means for detecting the alarm signal, and (f) central display means for decoding said forms of alarm signal and enabling indicators each corresponding to the forms of alarm signal detected.

15. A seed flow monitor as defined in claim 14 in which said identical alarm signal is comprised of a group of a predetermined number of pulses, each transmitting means in series being adapted to delete one of the pulses, the means for detecting the alarm signal being adapted to count the number of pulses detected thereat, the number being designative of a corresponding one or group of seed flow detectors.

16. A seed flow monitor as defined in claim 14, including central means for generating groups of said predetermined number of pulses, and for applying said group of pulses to the cable for applying to each transmitting means in parallel.

* * * * *